US006564403B1

(12) United States Patent
Titus

(10) Patent No.: US 6,564,403 B1
(45) Date of Patent: May 20, 2003

(54) BABY BUMPER PAD

(76) Inventor: Linda Titus, 6024 Palmetto St., Philadelphia, PA (US) 19111

( * ) Notice: Subject to any disclaimer, the term of this patent is extended or adjusted under 35 U.S.C. 154(b) by 0 days.

(21) Appl. No.: 10/117,828

(22) Filed: Apr. 8, 2002

(51) Int. Cl.[7] ..... A47D 7/00

(52) U.S. Cl. ..... 5/425; 5/424; 5/426; 5/663; 5/946; 5/93.1

(58) Field of Search ..... 5/93.1, 663, 946, 5/658, 424, 425, 426

(56) References Cited

U.S. PATENT DOCUMENTS 3,321,779 A 5/1967 Kaufman et al.
5,533,715 A 7/1996 Dandrea
5,542,135 A 8/1996 Ozrovitz et al.
5,806,112 A 9/1998 Harms
5,926,873 A 7/1999 Fountain

*Primary Examiner*—Teri Pham Luu
(74) *Attorney, Agent, or Firm*—Michael I. Kroll

(57) ABSTRACT

A crib bumper pad comprises an upper and lower barrier portion conjoined centrally by a zipper. The lower barrier portion is a plurality of non-removable, rectangular-shaped reinforcement plates encased within cloth and having a zipper on its top edge. The upper barrier portion is comprised of padding. Within the padding is a cloth-lined cavity with a sealable aperture whereby a removable reinforcement plate can also be inserted therein to provide for a sturdy barrier between a child and the crib's bars. The upper barrier portion attaches to the crib by a plurality of double straps. Additionally, the upper barrier portion connects to the lower barrier portion and crib by means of a zipper and a plurality of single securment straps. Also provided on the upper barrier portion is a securable releasable member whereby a pacifier may be placed thereon and attached thereto to prevent loss or misplacement of the pacifier.

14 Claims, 12 Drawing Sheets

BABY BUMPER PAD

BACKGROUND OF THE INVENTION

1. Field of the Invention

The present invention relates generally to a crib padding, more specifically to a crib bumper pad comprising a barrier providing a safe and impassable barrier to infants and toddlers. The barrier having an upper and lower barrier portion conjoined centrally by a zipper to allow separation.

The lower barrier portion is a plurality of reinforcement plates composed of a pliable semi-rigid polymeric material in a rectangular shape encased within cloth having a zipper on its top edge. The lower barrier portion is installed into a crib by placing the barrier in between the mattress and crib bars, this provides tension on the crib sheet and when connected to the upper barrier portion by the zipper, a means is provided to prevent an infant or toddler from engaging the bars of the crib frame underneath the upper barrier portion.

The upper barrier portion is comprised of padding contained within cloth. Within the padding a cloth-lined cavity is also provided with a sealable aperture whereby a reinforcement plate can also have access for insertion therein to provide for a sturdy barrier between a child and a crib's bars. The upper barrier portion attaches to the crib by a plurality of double straps on its top edge that tie typically to a crib's bars. Additionally, the upper barrier portion connects to the lower barrier portion and crib by means of the zipper and a plurality of single securement straps located at the distal ends of the barrier. Also provided on the upper barrier portion is a securable releasable tap whereby a pacifier may be placed thereon and attached thereto to prevent loss or misplacement of an infant or toddlers pacifier.

2. Description of the Prior Art

There are other crib bumper pad devices designed for infant and toddler safety. Typical of these is U.S. Pat. No. 3,321,779 issued to Kaufman et al., on May 30, 1967.

Another patent was issued to Dandrea on Jul. 9, 1996 as U.S. Pat. No. 5,533,715. Yet another U.S. Pat. No. 5,542,135 was issued to Ozrovitz et al on Aug. 6, 1996 and still yet another was issued on Sep. 15, 1998 to Harms as U.S. Pat. No. 5,806,112.

Another patent was issued to Fountain on Jul. 27, 1999 as U.S. Pat. No. 5,926,873.

U.S. Pat. No. 3,321,779

Inventor: Hester M. Kaufman et al

Issued: May 30, 1967

A mattress for baby cribs or the like which comprises: a mattress part; hinge members projecting from the lower portion of said mattress part; and guard members connected to an extending from said hinge members whereby the general outline of a cross is formed by said mattress part, hinge members and guard members in flat position, and an open box-like structure is formed when said guard members extend upwardly relative to said mattress; each of said hinge members projecting beyond said mattress part a distance approximating the thickness of its associated guard member, whereby when said guard members extend normally relative to said mattress part said guard members bear against the edges of said mattress part, the area of said mattress part together with the areas of the lower edges of said guard members being substantially equal to the mattress receiving area of said crib or the like.

U.S. Pat. No. 5,533,715

Inventor: Tamara H. Dandrea

Issued: Jul. 9, 1996

A safety barrier for railing systems for preventing entrapment, serious injury or death resulting from bodily penetration through the baluster support members of a railing system. The barrier substantially covers the horizontal space between vertical support members and the vertical space equal to the height of the balusters by weaving a mesh scrim or web of polyvinyl chloride in primary form plasticized between and along the balusters resulting in taut coverage of the open spacing. A border fabricated of reinforced nylon, canvas or like material is joined to each end of the barrier, having a plurality of openings to allow a means for tightly securing the barrier to an end wall, post or any combination thereof. The barrier is adaptable to lesser dimensions in terms of length and height.

U.S. Pat. No. 5,542,135

Inventor: Aaron Ozrovitz et al

Issued: Aug. 6, 1996

A self-retaining bumper pad for a bed is fabricated from elongated body of a soft, flexible material and includes a retention portion which fits between a side wall of the bed and an edge of the mattress and functions to hold the bumper pad in place. The pad further includes a shield portion which projects from the retention portion and overlies the side wall of the bed. The bumper pad cushions the side wall and also prevents a person who is in the bed from pushing an arm or a leg through the side wall of the bed.

U.S. Pat. No. 5,806,112

Inventor: Antionette Harms

Issued: Sep. 15, 1998

A crib liner for lining a baby crib including a flexible base member for being located beneath a mattress of the crib, and a side guard attached to the periphery of the base member for lining the side walls of the crib so as to keep a baby's arms and legs inside the crib while the baby is lying down therein. The side guard is preferably attached to the base member continuously along the periphery thereof. A plurality of fasteners are attached to the side guard for attaching the crib liner to the posts and bars of the crib. In a preferred embodiment of the present invention, the base member is formed from a fabric material, and the side guard is sewn onto, or otherwise attached to the base member, preferably continuously therearound.

U.S. Pat. No. : 5,926,873

Inventor: Irene Fountain

Issued: Jul. 27, 1999

A railing guard is provided for alleviating previous deficiencies with crib protectants. The crib railing guard disclosed protects infants from injury and discomfort resulting from impact against and contact with side railing on baby cribs. Furthermore, the crib railing guard provides a self-supportive, comfortable enclosure for care of infants on surfaces with or without side railing. The crib railing guard is composed of a base, a cushiony wall and fasteners. The base is sized and shaped to correspond to an infant mattress. The base, when used in conjunction with an infant bed, is placed on top of the mattress support structure and beneath the mattress. The cushiony wall is connected to the perimeter of the base and projects upward. The lower portion of the cushiony wall is designed to compress when a mattress is placed on top of the base in order to fit the crib railing guard between the crib railing and the mattress. The fasteners are located around the outside of the cushiony wall to enable attachment to the crib railing in pre-selected order to maintain the cushiony wall in a position against the crib railing.

While these crib padding devices may be suitable for the purposes for which they were designed, they would not be as suitable for the purposes of the present invention, as hereinafter described.

SUMMARY OF THE PRESENT INVENTION

The present invention discloses a crib bumper pad comprising an upper and lower barrier portion conjoined centrally by a zipper to allow separation thereof. The lower barrier portion is a plurality of non-removable reinforcement plates composed of a pliable semi-rigid polymeric material in a rectangular shape encased within cloth having a zipper on its top edge. The lower barrier portion is installed into a crib by placing the barrier in between the mattress and crib bars providing tension on the crib sheet and when connected to the upper barrier portion by the zipper and a means to prevent an infant or toddler from engaging the bars of the crib frame underneath the upper barrier portion. The upper barrier portion is comprised of padding contained within cloth. Within the padding a cloth-lined cavity is also provided with a sealable aperture whereby a removable reinforcement plate can also be inserted therein to provide for a sturdy barrier between a child and a crib's bars. The upper barrier portion attaches to the crib by a plurality of double straps on its top edge that tie typically to a crib's bars. Additionally, the upper barrier portion connects to the lower barrier portion and crib by means of the zipper and a plurality of single securement straps located at the distal ends of the barrier. Also provided on the upper barrier portion is a securable releasable member whereby a pacifier may be placed thereon and attached thereto to prevent loss or misplacement of the pacifier.

A primary object of the present invention is to provide a crib bumper that an infant or toddler can not slip its head or limb under Another object of the present invention is to provide a crib bumper that an infant or toddler can not pull on or contort.

Yet another object of the present invention is to provide a crib bumper that helps increase sheet tension when placed into and around a cribs mattress.

Still yet another object of the present invention is to provide a crib bumper having a zipper with a sheath to provide separable upper and lower barrier portions.

Yet another object of the present invention is to provide a crib bumper with reinforcement plates to strengthen the form of the bumper preventing manipulation of its shape.

Still yet another object of the present invention is to provide a crib bumper with a plurality of double and single straps to secure the bumper inside the crib.

Yet another object of the present invention is to provide a crib bumper with padding on its upper barrier portion.

Still yet another object of the present invention is to provide a crib bumper with a sealable aperture for the placement into of a reinforcement plate.

Yet another object of the present invention is to provide a crib bumper with a pacifier holder to reduce the chances of loosing an infant or toddlers pacifier.

Additional objects of the present invention will appear as the description proceeds.

The present invention overcomes the shortcomings of the prior art by providing a crib bumper that provides a barrier that an infant or toddler cannot slip its head or limbs under or contort in any fashion comprising a barrier that is separateable into an upper and lower portion by releasing a sheathed zipper. Also, by providing a lower barrier portion that helps to maintain sheet tension and an upper barrier portion with a pacifier holder and double and single securement straps for installation of the present invention against the cribs bars. Also, by providing pads reinforced with a reinforcement plates made of pliable polymeric material to provide added strengthen against contortion.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
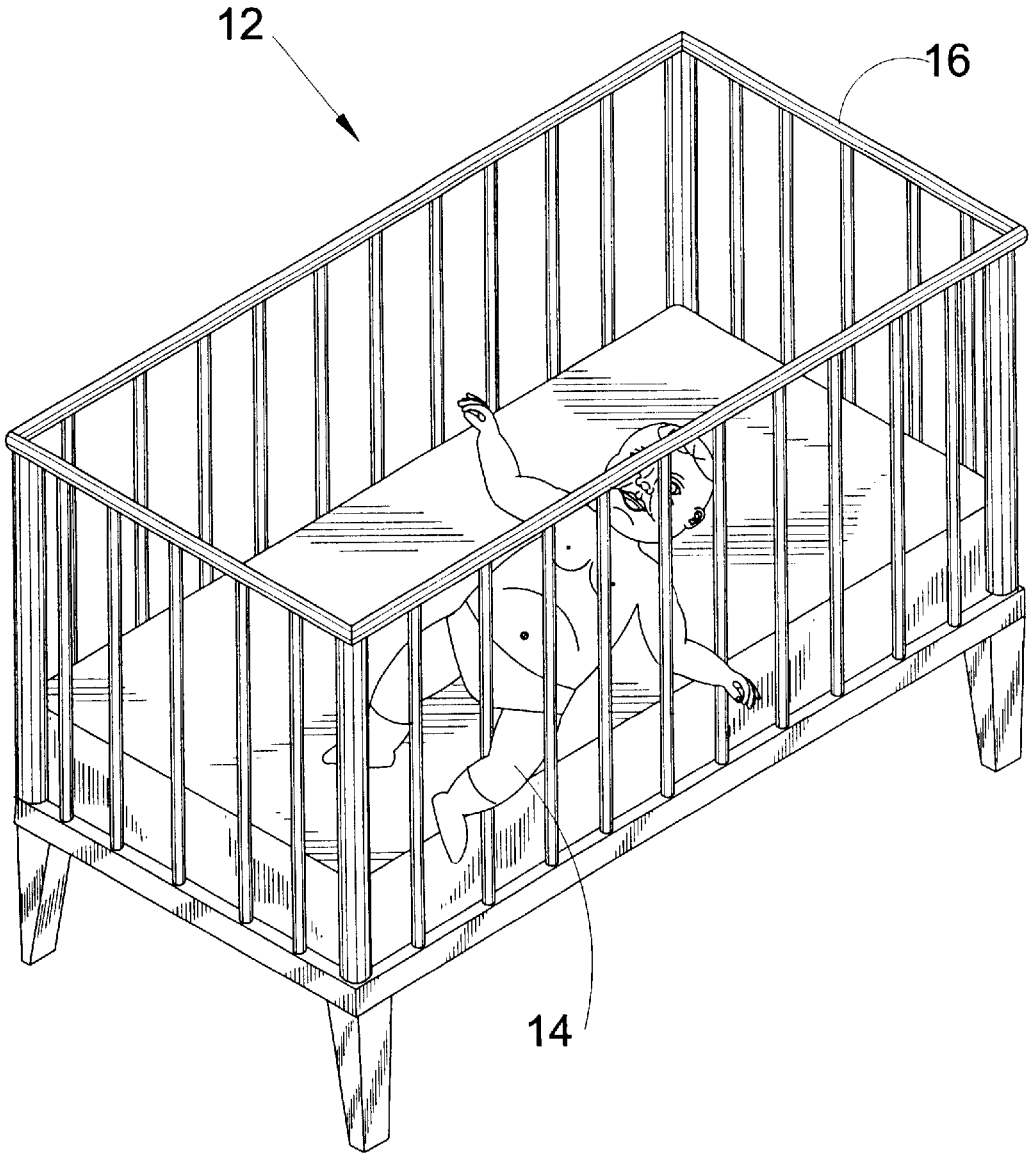
FIG. 1 PRIOR ART
FIG. 1 is a perspective view of the prior art.

With regard to reference numerals used, the following numbering is used throughout the drawings.

10 present invention

12 prior art

14 infant

16 crib

18 upper barrier portion
20 lower barrier portion
22 single securement strap
24 double securement strap
26 crib bars
28 zipper
30 zipper sheath
32 pacifier holder
34 mattress
36 sheet
38 floorboard
40 reinforced pad
42 closing snaps
44 aperture
46 reinforcement plate
48 cloth
50 padding
52 direction arrow
54 rounded edges
56 snap
58 pacifier
60 cavity

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to the appended claims.

Turning to FIG. 1, shown therein is a perspective view of the prior art 12. Shown is an infant 14 placed in a crib 16 where during its time in the crib it managed to get its leg and arm stuck between the bars of the crib causing a dangerous predicament for the infant to be in.

Figure 2:
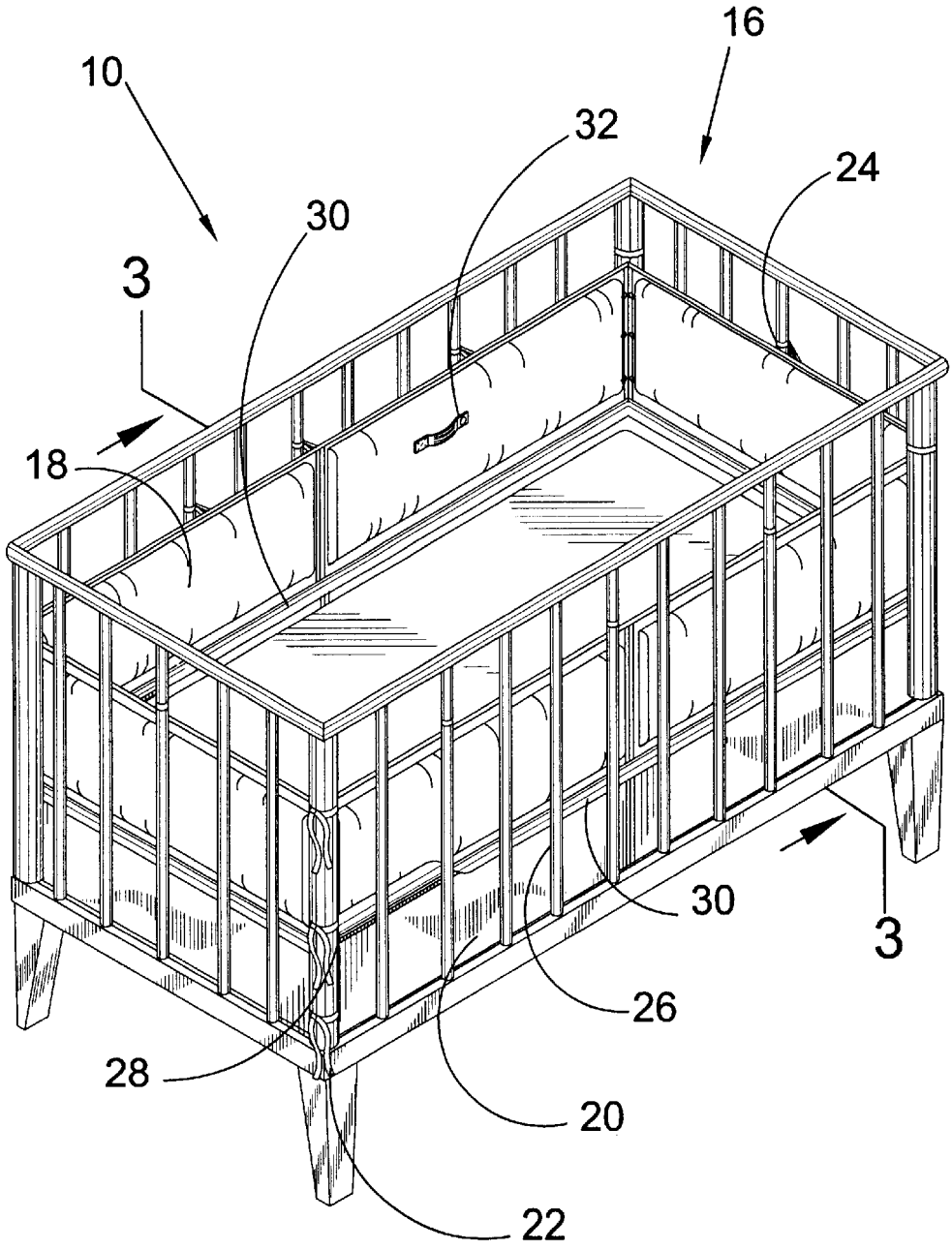
FIG. 2 is a perspective view of the present invention installed on a crib.

Turning to FIG. 2, shown therein is a perspective view of the present invention 10 installed on a crib 16. Shown is the present invention 10 having an upper barrier portion 18 and a lower barrier portion 20 installed onto a crib 16 by tying the single 22 and double 24 securement straps to the cribs side bars 26. When the present invention is installed in the crib a barrier is created against the lower portion of the bars whereby a child cannot project any of its limbs though or under the bars. Also shown is a zipper 28 within zipper sheath 30 along with a pacifier holder 32.

Figure 3:
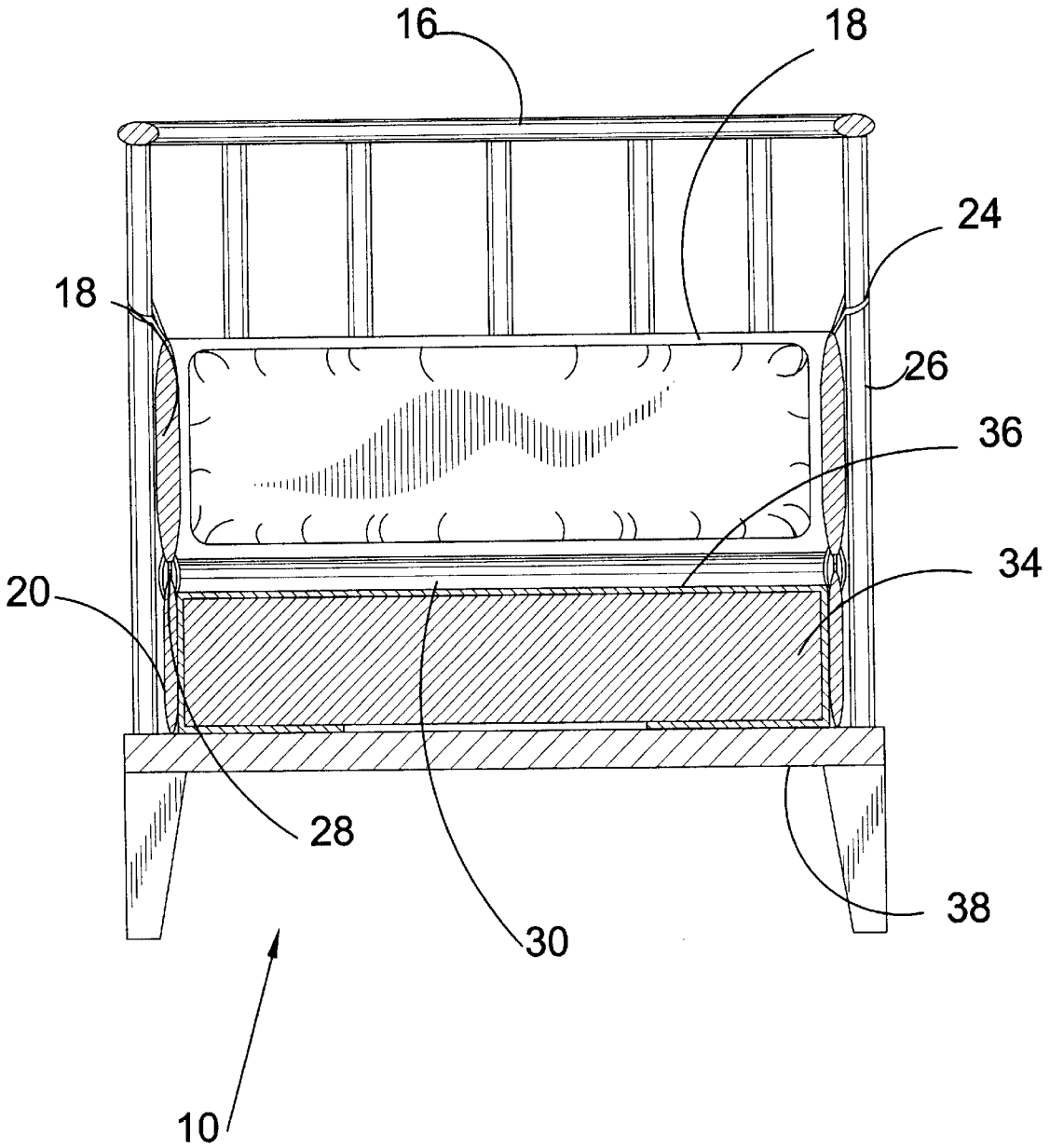
FIG. 3 is a cross section of the present invention installed on a crib.

Turning to FIG. 3, shown therein is a cross section of the present invention 10 installed on a crib 16. Shown is a cross section of the present invention showing the lower barrier portion 20 being in between the mattress's 34 side and the crib bars 26, whereby the sheet 36 in between the lower wall portion and mattress will be subjected to pressure between the two providing added tension of the sheet's 36 placement and position. Also shown is a floorboard 38 of the crib 16 along with other elements previously disclosed.

Figure 4:
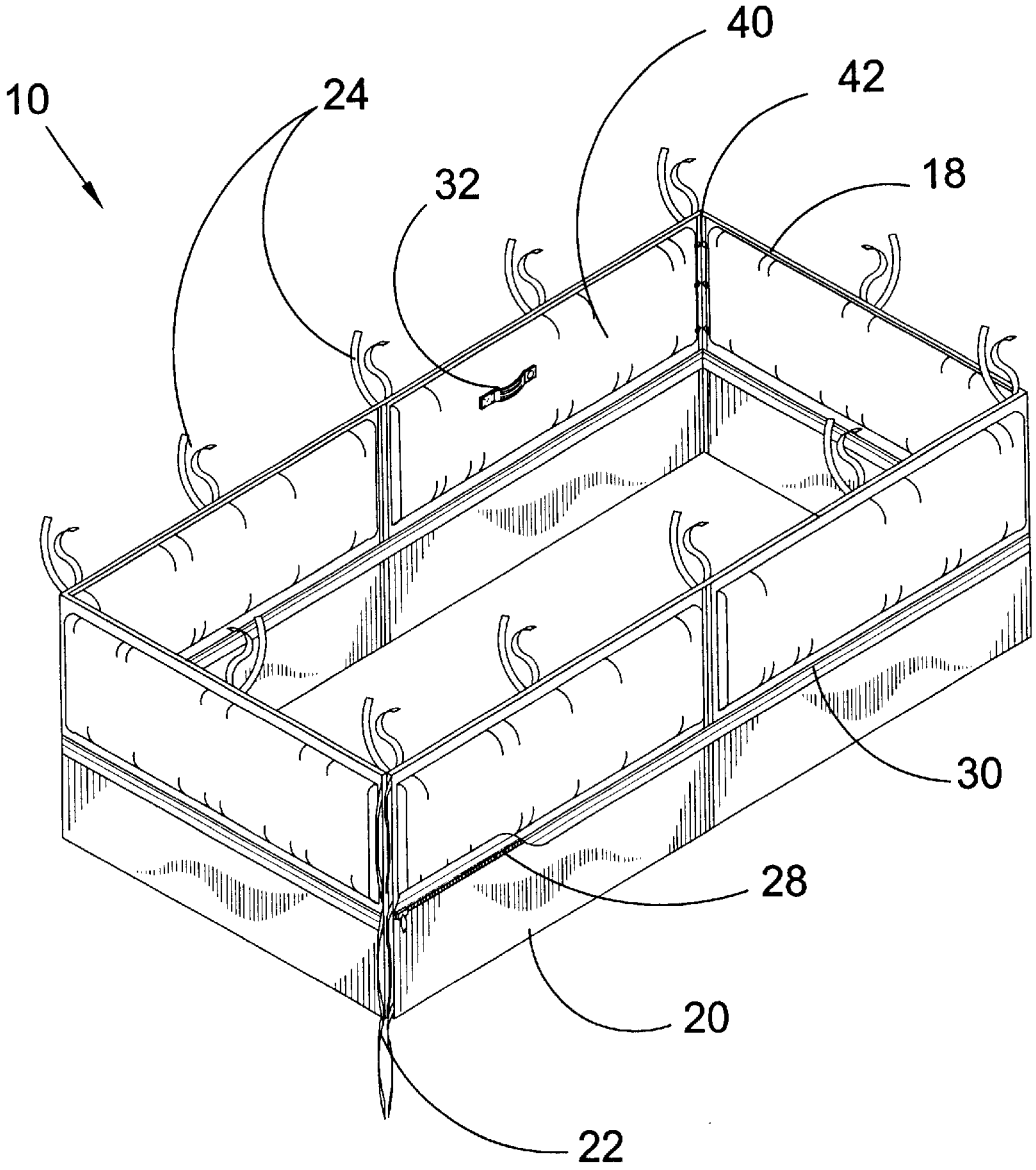
FIG. 4 is a perspective view of the present invention.

Turning to FIG. 4, shown therein is a perspective view of the present invention 10. Shown is the present invention folded into a form that may be installed into a baby's crib with the present invention having an upper barrier portion 18 with reinforced pads 40 that attach to crib bars by single 22 and double 24 securement straps to provide a barrier to prevent an infant or toddlers access to the crib bars. A lower barrier portion 20 with a zipper 28 within zipper sheath 30 is placed between the mattress and the crib frame and is attached by zipper 28 to the bottom of the upper barrier portion 18 to prevent the infant or toddler from gaining access to the bars by going under the upper barrier portion 18 and to help in the tensioning of the sheet. Also shown are the pacifier holder 32 and closing snaps 42.

Figure 5:
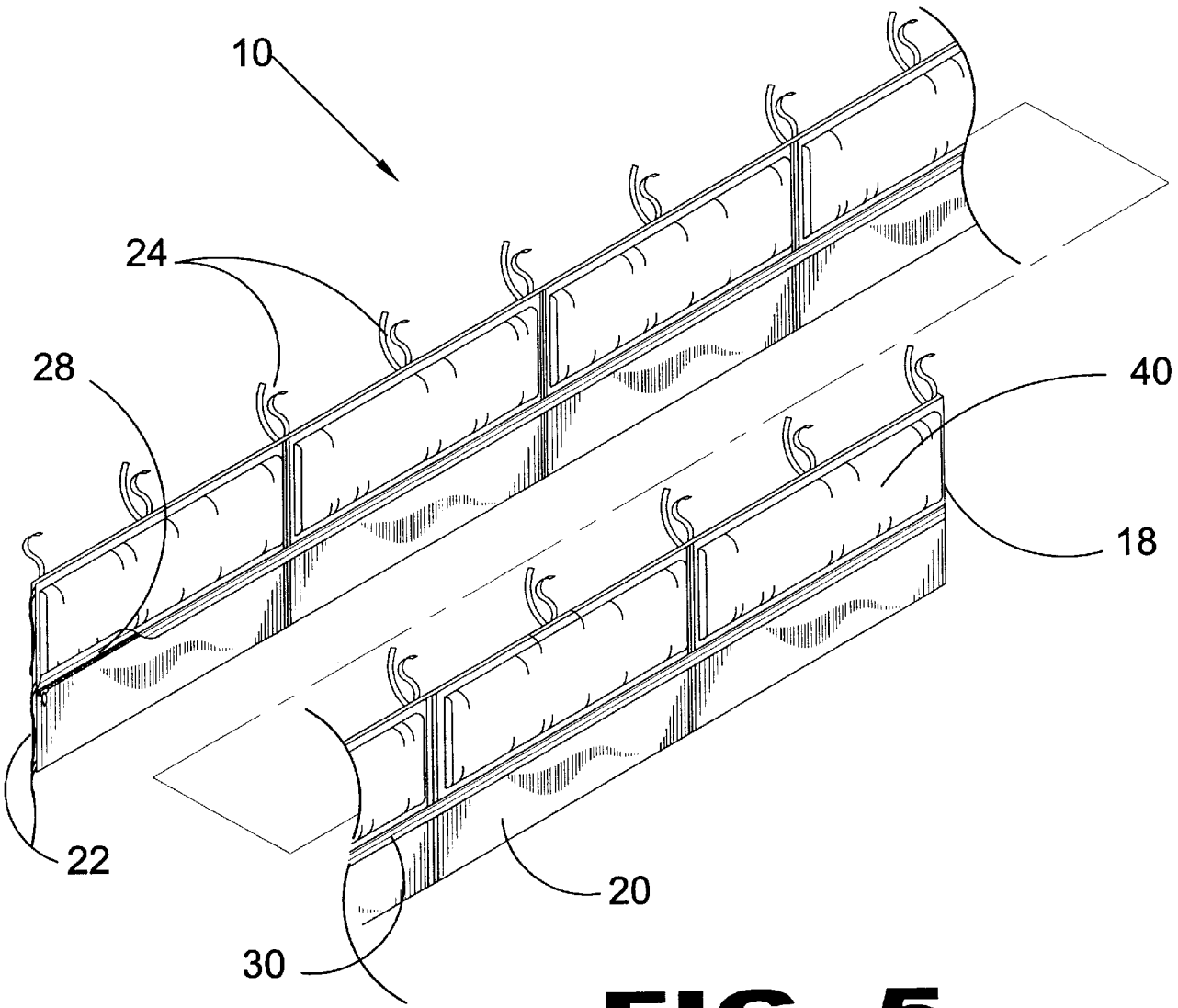
FIG. 5 is a outside perspective view of the present invention.

Turning to FIG. 5, shown therein is a outside perspective view of the present invention 10. Shown is the present invention having an upper barrier portion 18 with reinforced pads 40 therein that maintain their shape even if an infant or toddler kicks, pushes or pulls on them so that a steady, soft and safe barrier is maintained against the cribs bars. Also shown are other elements previously disclosed.

Figure 6:
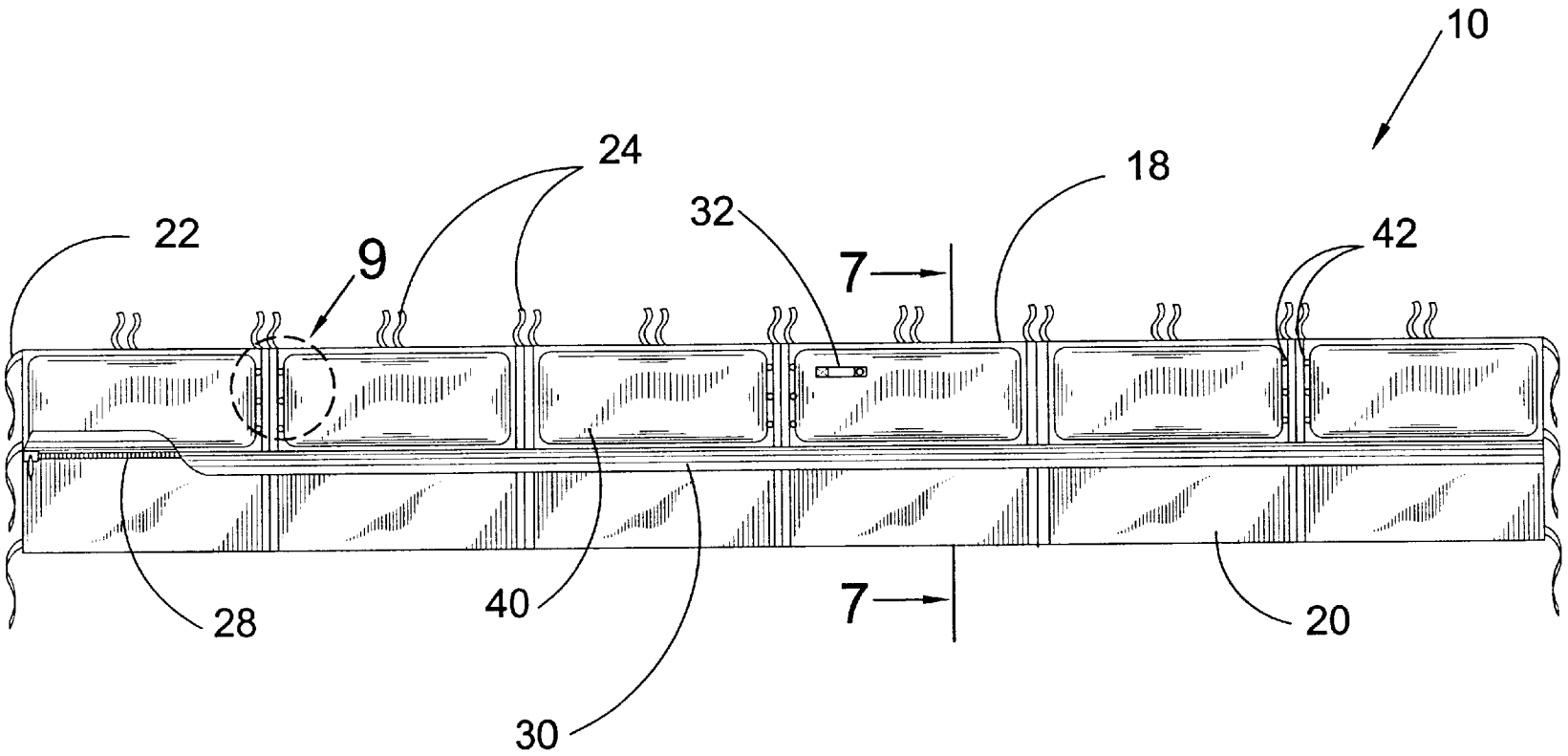
FIG. 6 is a front inside view of the present invention.

Turning to FIG. 6, shown therein is a front inside view of the present invention 10. Shown is the inside surface of the present invention showing the present invention having a pacifier holder 32 to prevent the loss or misplacement of a baby's pacifier and a plurality of closing snaps 42 to open and seal the aperture in the reinforced pads 40 so that placement and removal of the reinforcement plate (not shown but see FIG. 7) contained therein can occur. Also shown are other elements previously provided.

Figure 7:
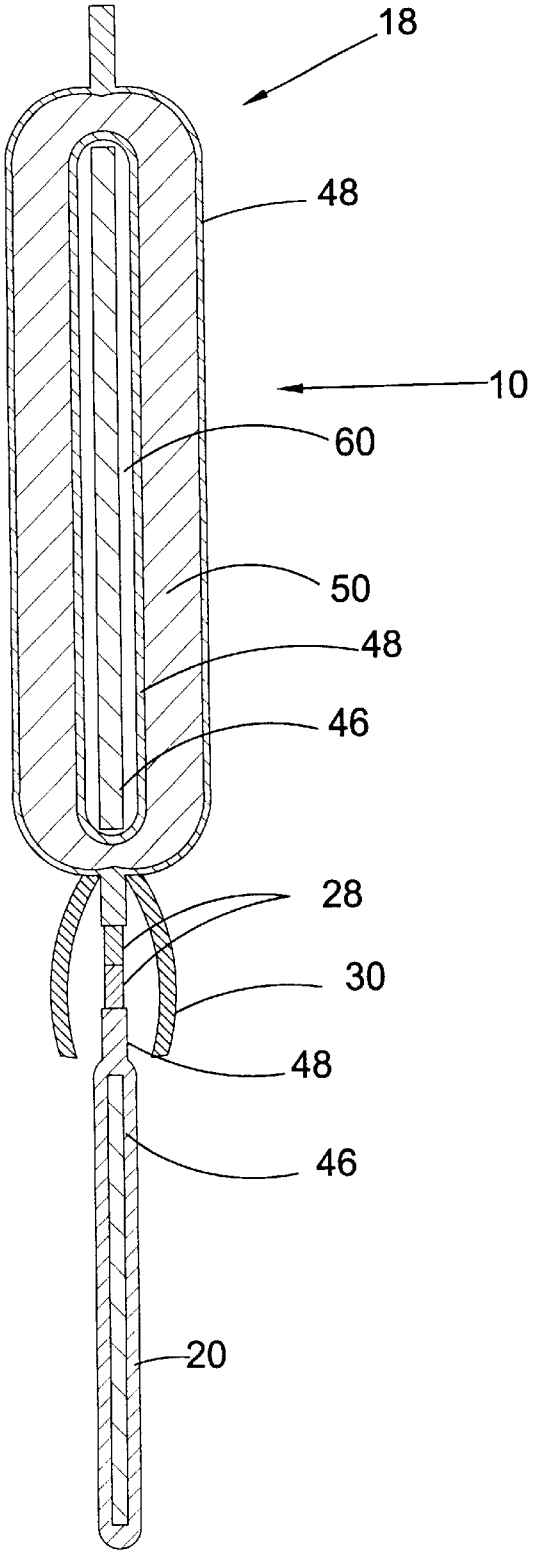
FIG. 7 is cross section of the present invention.

Turning to FIG. 7, shown therein is cross section of the present invention 10. Shown is the present invention having a reinforcement plate 46 in both the upper barrier portion 18 and lower barrier portion 20 to provide rigidity to each barrier. Also shown are the barrier portions having a zipper 28 within zipper sheath 30 to connect the two barrier portions 18, 20 with a sheath 30 to hide and conceal the zipper 28 from infant or toddler interaction. Also shown are cloth 48 and padding 50 always with the cavity 60 in the upper barrier 18.

Figure 8:
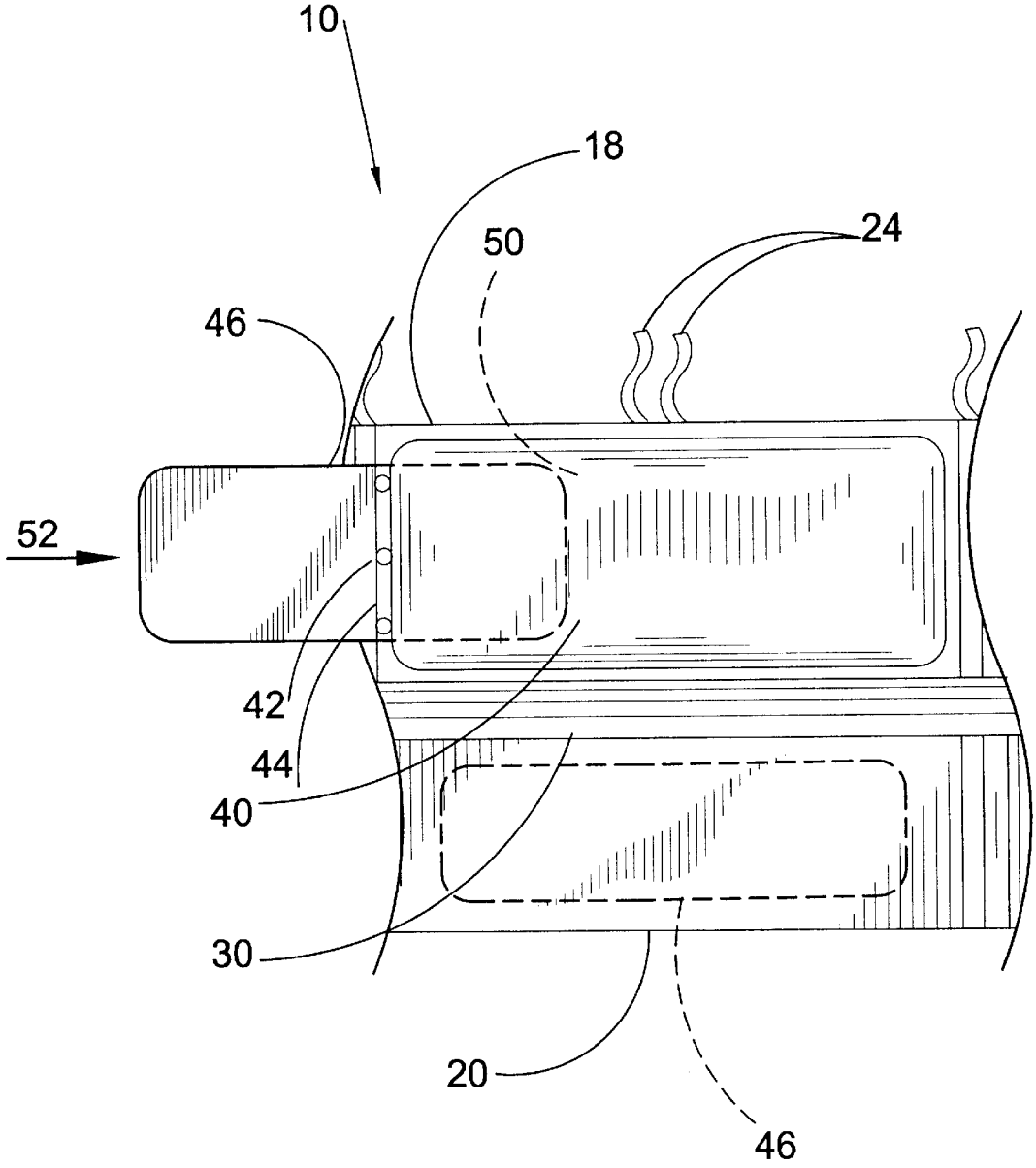
FIG. 8 is a front view of the present invention.

Turning to FIG. 8, shown therein is a front view of the present invention 10. Shown is the present invention having a reinforcement plate 46 in both the upper 18 and lower 20 barrier portions of the present invention. The upper barrier portion 18 has a padding material 50 with a cavity 60 (not shown but see FIG. 7) therein with an aperture 44 and multiple closure means 42 for the insertion and removal of the reinforcement plate 46. This helps to aid in the cleaning process by allowing removal of the plate 46. The lower barrier portion 20 has a non-removable, reinforcement plate 46 sewn into its structure. Direction arrows 52 indicate the insertion of the plate 46 through aperture 44 into the upper barrier portion 18. Other elements previously disclosed are also shown.

Figure 9:
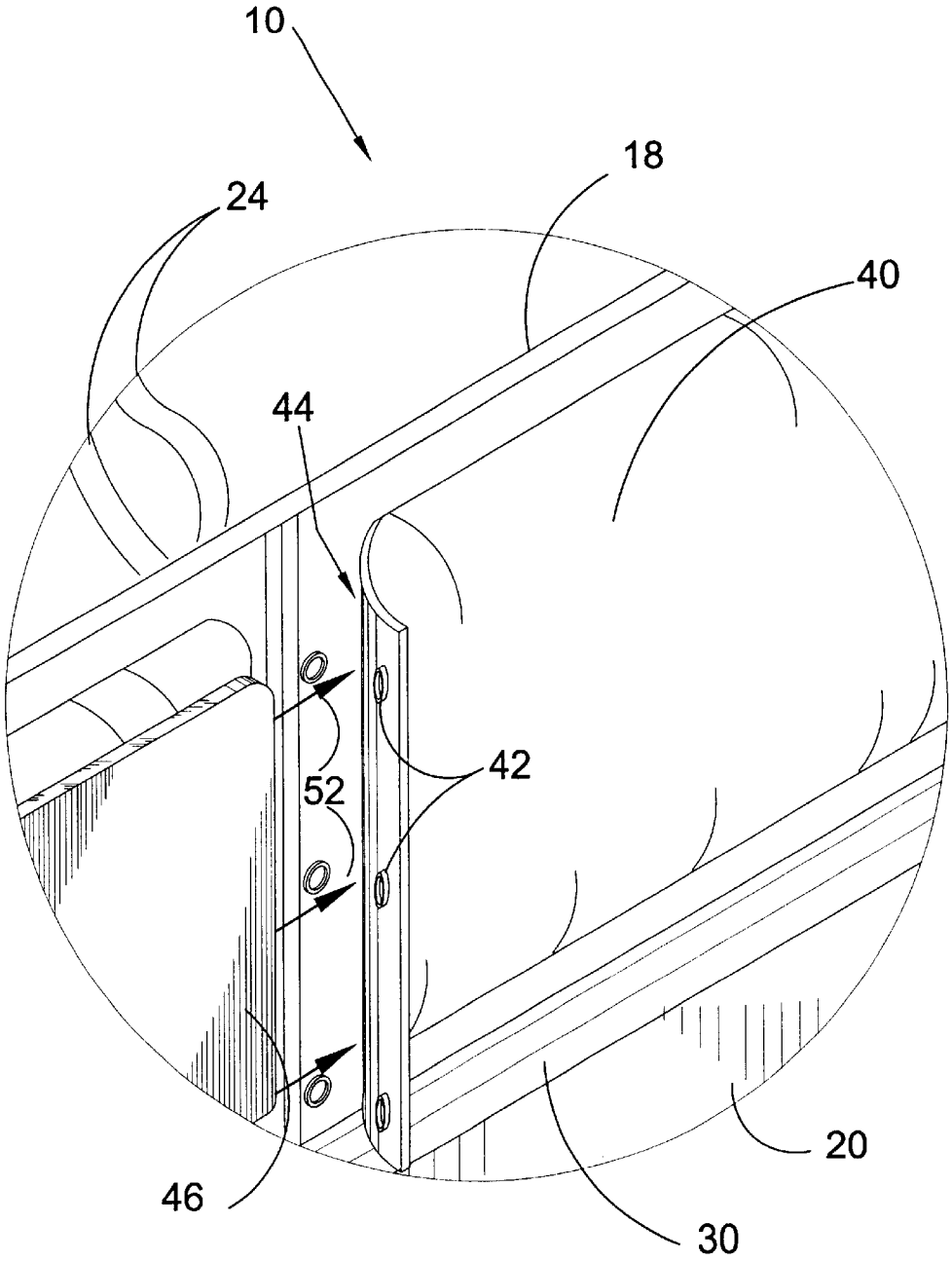
FIG. 9 is a detailed view of the present invention.

Turning to FIG. 9, shown therein is a detailed view of the present invention 10. Shown is the reinforced pad 40 with its closing snaps 42 opened to allow for the reinforcement plate 46 to be inserted as shown by arrows 52 through aperture 44 so that the reinforcement plate 46 may provide additional strength to the pad 40 so that an infant or toddler may not contort or bend the upper barrier portion's 18 shape. Other elements previously disclosed are also shown.

Figure 10:
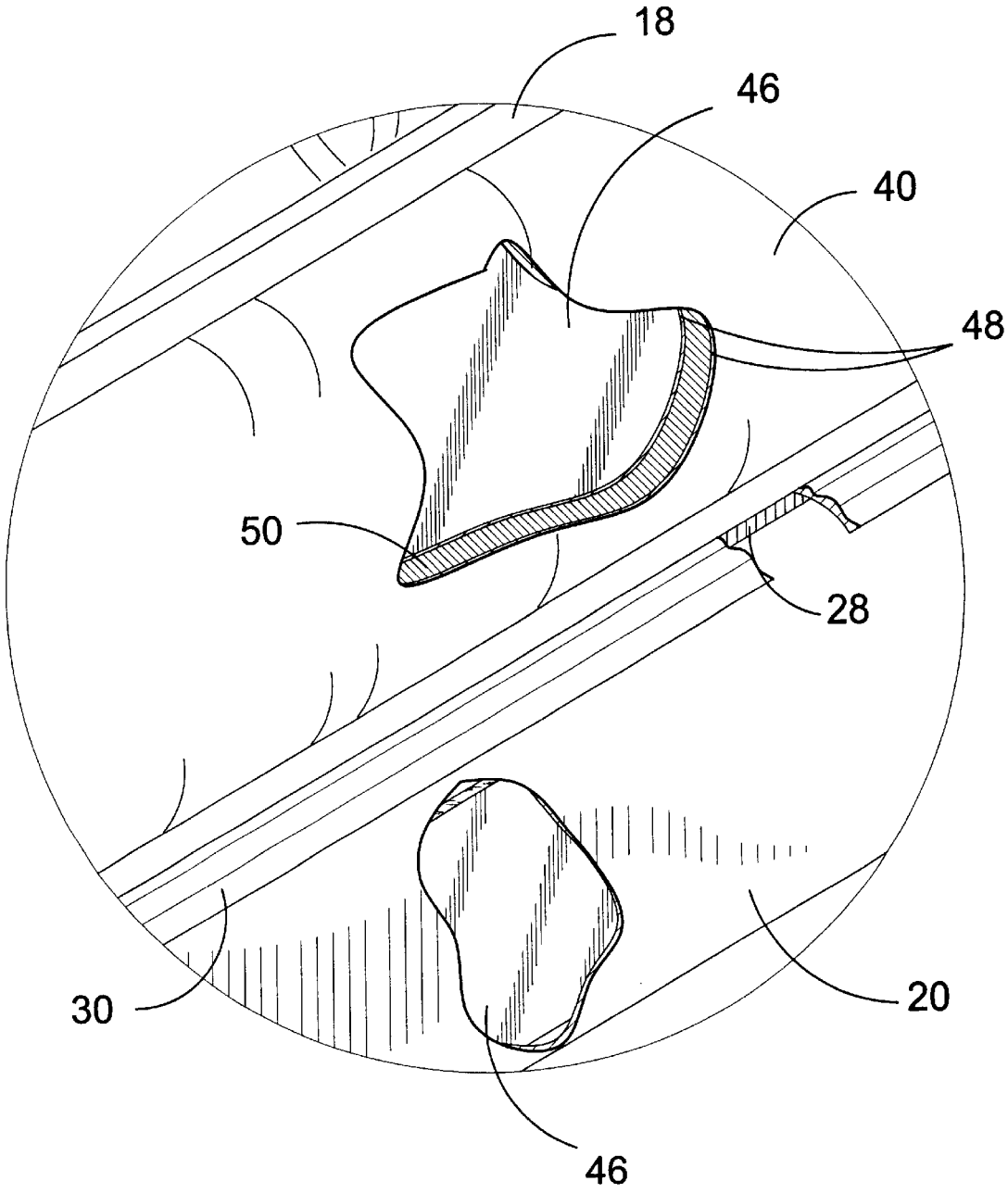
FIG. 10 is a detailed cutaway view of the present invention.

Turning to FIG. 10, shown therein is a detailed cutaway view of the present invention. Shown is the present invention having a plurality of reinforcement plates 46 to hold the upper 18 and lower 20 barrier portions in a solid, consistent shape with the upper barrier portion 18 having additional padding 50 surrounding the reinforcement plate 46 to provide additional safety for the infant or toddler from bumps and bruises that may otherwise occur from the unpadded plate. Also shown is the reinforced pad 40 and cloth 48. Also shown is the zipper sheath 30 with a portion removed to show the zipper 28 underneath.

Figure 11:
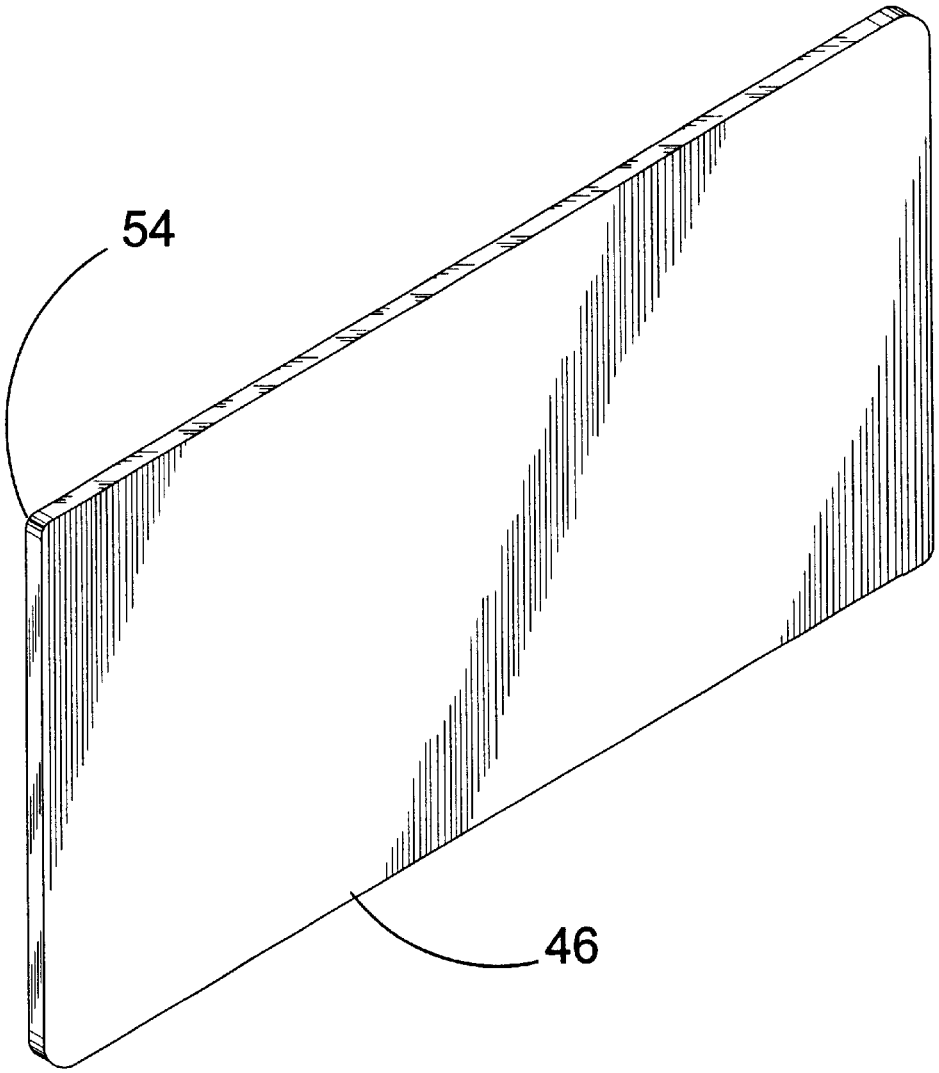
FIG. 11 is a perspective view of the reinforcement plate.

Turning to FIG. 11, shown therein is a perspective view of the reinforcement plate 46. The reinforcement plate 46 is comprised of a semi-rigid, pliable polymeric material having a rectangular shape with rounded corners 54 to eliminate any possible hazards the reinforcement plate 46 might present.

Figure 12:
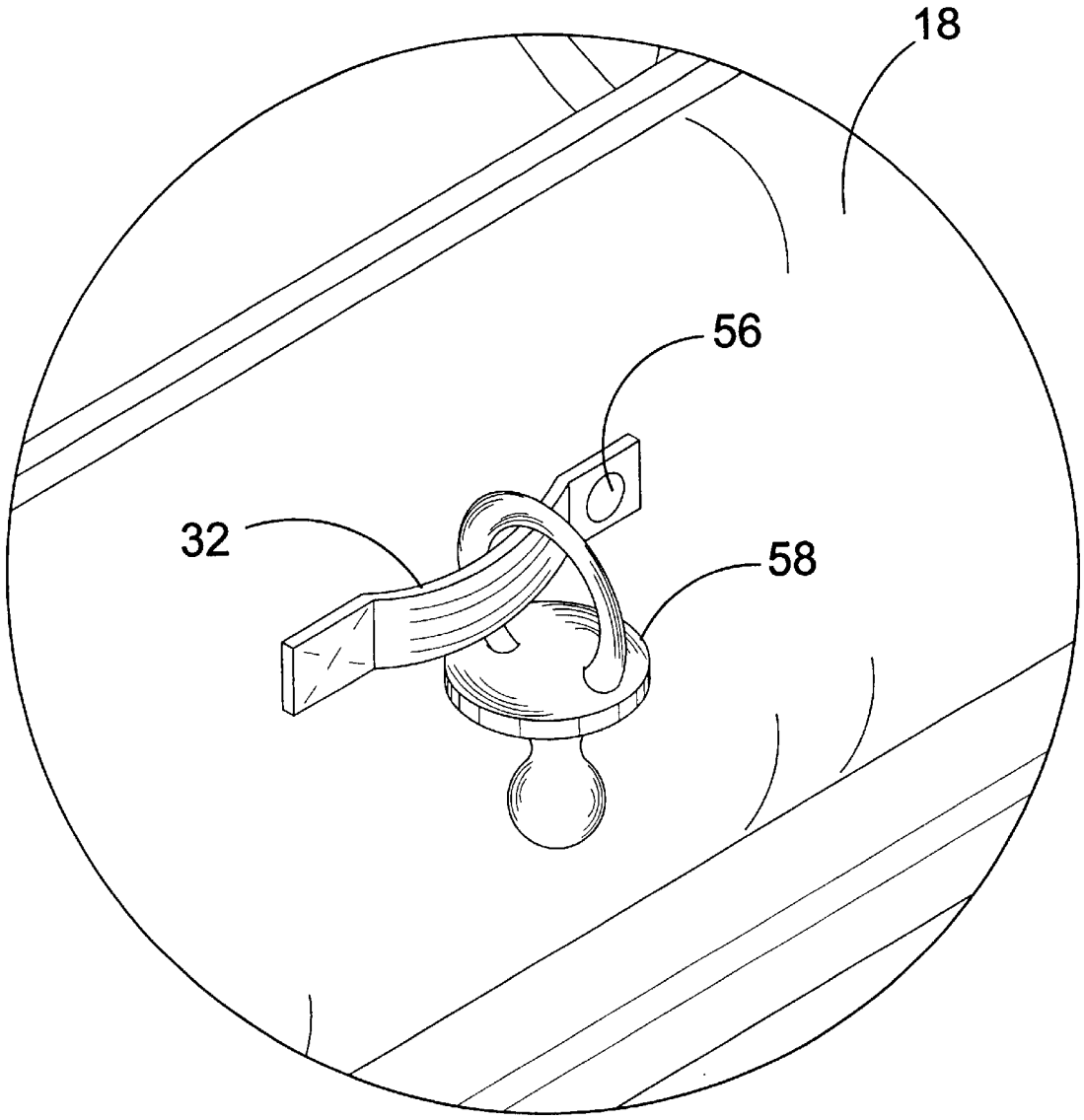
FIG. 12 is a perspective view of the pacifier holder.

Turning to FIG. 12, shown therein is a perspective view of the pacifier holder 32. Shown is the present invention having a pacifier holder 32 sewn to the interior portion of the upper barrier portion 18 for quick access and to help in the reduction of lost or misplaced pacifiers. A snap 56 is shown for removably connecting the holder 32 along with a pacifier 58 therein.

I claim:

1. An apparatus for a padded barrier for protection of an infant placed inside a conventional baby crib, the crib having an upright standing frame having crib bars thereon along with a mattress, the mattress being supported by a crib floorboard, the mattress having a sheet placed thereon in a conventional manner, comprising:

a) an upper barrier portion, said upper barrier comprising a plurality of rectangular elongated sections, said sections being generally upstanding planar members, each said section having a cavity therein, each said section having an aperture on one edge thereof, each section having an upper and lower portion and an inside and outside surface;

b) padding disposed about each section, said padding having a cloth covering;

c) a first reinforcement plate, said plate being generally a rectangular planar member, said plate passing through said aperture for being removably disposed internal said cavity of said upper barrier portion;

d) a lower barrier portion, said lower barrier portion comprising a plurality of rectangular elongated sections, said sections being generally upstanding planar members, each said section having a cavity therein, each section having an upper and lower portion and an inside and outside surface;

e) wherein said lower barrier portion comprises cloth for covering a second reinforcement plate therein;

f) a second reinforcement plate, said plate being generally a rectangular planar member, said plate securely disposed internal said lower barrier portion;

g) a first means of attaching said upper barrier portion to said lower barrier portion; and, h) a second means of attaching said upper and lower barrier portion to the interior of the crib.

2. The apparatus of claim 1, wherein said first reinforcement plate is removable from said upper barrier portion.

3. The apparatus of claim 2, wherein said first reinforcement plate is removable from said upper barrier portion wherein said first reinforcement plate is removable by being passed through said aperture of said upper barrier portion.

4. The apparatus of claim 3, wherein said second reinforcement plate is secured within said lower barrier portion.

5. The apparatus of claim 4, wherein said first means for attaching said upper barrier portion to said lower barrier portion comprises a zipper.

6. The apparatus of claim 5, wherein said zipper attaches said lower portion of said upper barrier portion to said upper portion of said lower barrier portion.

7. The apparatus of claim 6, further comprising a zipper sheath disposed about said zipper for covering said zipper.

8. The apparatus of claim 7, wherein said second means for attaching said upper and lower barrier portions to the interior of the crib comprises a plurality of straps for being tied about the crib.

9. The apparatus of claim 8, wherein said plurality of straps comprise single straps disposed on said upper and lower barrier portions.

10. The apparatus of claim 9, wherein said plurality of straps comprise double straps disposed on said upper barrier portions.

11. The apparatus of claim 10, further comprising a plurality of closure snaps disposed on said aperture of said cavity of said upper barrier portion for securely closing said aperture.

12. The apparatus of claim 11, further comprising means for holding a pacifier disposed on said inside surface of said upper barrier portion whereby a pacifier may be removably secured thereto.

13. The apparatus of claim 12, wherein said means for holding a pacifier comprises a length of flexible material, said material having a first and second end, said first end being fixedly attached to said upper barrier portion and said second end being removably attached to said upper barrier portion.

14. The apparatus of claim 13, further comprising a snap-on said second end of said flexible material for removably attaching said material to said upper barrier portion.

* * * * *